United States Patent [19]

Zubrod

[11] Patent Number: 4,782,649

[45] Date of Patent: Nov. 8, 1988

[54] ADJUSTABLE SUPPORT FOR STIRRUP STRAP

[76] Inventor: Bruce R. Zubrod, 114 Brookridge Dr., Lavergne, Tenn. 37086

[21] Appl. No.: 36,439

[22] Filed: Apr. 9, 1987

[51] Int. Cl.[4] ..... B68C 1/16

[52] U.S. Cl. ..... 54/46

[58] Field of Search ..... 54/46, 47

[56] References Cited

U.S. PATENT DOCUMENTS 34,044 12/1861 Eagle ..... 54/46

4,473,992 10/1984 Conger, III ..... 54/46

FOREIGN PATENT DOCUMENTS 2053647 2/1981 United Kingdom ..... 54/44

*Primary Examiner*—Robert P. Swiatek

*Attorney, Agent, or Firm*—Harrington A. Lackey

[57] ABSTRACT

A support device for adjustably supporting and locking a hanger bar member carrying a stirrup strap in predetermined axial positions along a support bar fixed to one side of the saddle. The hanger bar member includes a sleeve having a detent adapted to travel in channels formed in the surface of the support bar for positioning and locking the hanger bar member and the stirrup strap in various positions upon the saddle.

7 Claims, 1 Drawing Sheet

ADJUSTABLE SUPPORT FOR STIRRUP STRAP

BACKGROUND OF THE INVENTION

This invention relates to a support device for adjustably attaching a stirrup strap to a saddle, and more particularly to a support device for not only positioning, but also locking the hanger bar member in its adjusted position upon the saddle.

Stirrup bars or hanger bars having open rear ends for releasably carrying a stirrup strap to permit the stirrup and strap to immediately disengage the stirrup bar when a rider falls from his horse, are well known in the art. Furthermore, longitudinally adjustable stirrup straps are also known, support devices carrying a stirrup strap adapted to be longitudinally positioned relative to the saddle, without the rider dismounting. Examples of the above-described prior art are illustrated in the following patents:

| | | |
|---|---|---|
| | U.S. PATENTS | |
| 1,174,489 | Giles | Mar. 7, 1916 |
| 1,335,826 | Faithfull | Apr. 6, 1920 |
| 2,739,434 | Bell | Mar. 27, 1956 |
| | FOREIGN PATENTS | |
| British Patent No. 2,053,647 | | July 17, 1979 |

Each of the above Giles, Faithfull, and the British patents discloses a stirrup strap hook or hanger member fixed to a saddle, and having an open rear end to release the stirrup strap if the rider accidentally falls from the saddle.

The above Bell U.S. Pat. No. 2,739,434 and the British patent disclose longitudinally adjustable hanger devices for adjustably supporting a stirrup strap from a saddle.

The above cited British patent No. 2,053,647 discloses two modifications of a stirrup strap hook or hanger supported upon a longitudinal stirrup rod or tube fixed at both ends to the saddle to permit rotation of the hanger member for longitudinal movement and counter-rotation for locking the hanger member in an adjusted position upon the fixed stirrup rod or tube.

Adjustable stirrup strap support devices are on the market which resemble those disclosed in the above British patent, and particularly the device disclosed in FIGS. 1 and 2 of the British patent, with certain modifications. The commercially available support devices, similar to FIGS. 1 and 2 of the British patent, include an elongated travel slot in the surface of a cylindrical support rod, having the same function as the keyway 8 in the British patent. The longitudinal travel channel is intercepted by a plurality of longitudinally spaced, circumferential position slots having the same function as the grooves 7 in the British patent. The commercial stirrup hangers utilize a ball detent, instead of the key 11 of the British patent, in order to travel along the travel channel and in the position channels of the support rod.

However, it has been found that in the commercial stirrup support devices, even when the hanger is supposedly secured in position upon the support rod, the ball detent tends to move so freely in its corresponding position channel that it sometimes enters the travel channel, causing the hanger sleeve to move along the travel channel and out of its desired stirrup position.

SUMMARY OF THE INVENTION

It is therefore an object of this invention to improve the above-described commercial stirrup bar device by providing means for locking the hanger device upon the support bar after it has been moved to its proper stirrup position.

The stirrup support device made in accordance with this invention includes an elongated cylindrical rod having an elongated travel channel intercepted by longitudinally spaced, circumferential position channels, in the same manner as the above prior art commercial support devices. The hanger member utilized in this invention is substantially the same as that utilized in the commercial stirrup support devices including the cylindrical sleeve having a ball detent adapted to ride in the travel and position channels. The hanger member also carries a hanger bar projecting rearwardly and having a rear open end to permit disengagement of the stirrup strap loop in the event of an accident, such as the falling of a rider from the saddle.

However, in the support device made in accordance with this invention, a locking channel is formed in the cylindrical surface of the support rod intercepting and extending rearwardly from each position channel to receive the ball detent in the hanger member from its corresponding position channel, prevent the hanger device from inadvertently rotating about the support rod while the rider is mounted and his foot is engaged in the stirrup.

Accordingly, the stirrup support device including the locking channels made in accordance with this invention provide a much more comfortable and safer stirrup support, without sacrificing the ability of the stirrup strap to readily disengage should the rider fall from his mount with his foot caught in the stirrup.

DESCRIPTION OF THE PREFERRED EMBODIMENT

Figure 1:
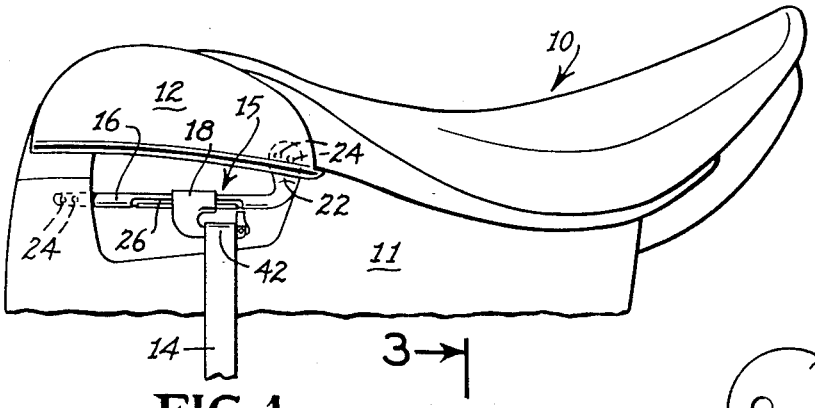
FIG. 1 is a left side elevation of a saddle, shown fragmentarily, with the flap raised to show the stirrup support device made in accordance with this invention operatively supported upon the saddle, the stirrup strap being shown fragmentarily.

FIG. 1 discloses, fragmentarily, a typical English saddle 10 including a skirt 11 and a side flap 12 fabricated upon a saddle tree, hidden beneath the saddle disclosed in FIG. 1 Saddle 10 also includes a stirrup strap or stirrup leather 14, shown fragmentarily, from which is supported a stirrup, not shown, supported at the lower end of the strap 14.

The stirrup support device 15, made in accordance with this invention is disclosed in FIG. 1 supported upon the left side of the saddle 10, for adjustably supporting the stirrup strap 14, in operative position. The support device 15 basically includes two cooperating parts, namely, an elongated support bar 16 and the hanger bar member 18 adjustably carried by the support bar 16.

The support bar 16 is preferably substantially straight and generally cylindrical throughout most of the its length. The front end portion 19 of the support bar 16 is preferably flattened and provided with fastener holes 20, while the rear end portion 22 projects laterally upward, is flattened and is likewise provided with fastener holes 23. Thus, the support bar 16 is fixedly mounted to a desired portion of the saddle, such as the saddle tree, not shown, by brads, bolts, or other appropriate fastener means 24 extending through the fastener holes 20 and 23 and secured directly to the saddle tree or other portion of the saddle 10, as best disclosed in FIG. 1.

Formed longitudinally in the surface of the cylindrical support bar 16, and preferably along the outer side of the support bar 16 is an elongated travel channel or groove 26, preferably of uniform radial depth. The travel channel 26 preferably has its opposite ends closed and is preferably less than the length of the support bar 16.

Interconnecting or in communication with the travel channel 26 are a plurality of longitudinally spaced position channels 27 which extend circumferentially from the travel channel 26 beneath the support bar 16, preferably at least through an arc of 90 deg. Also, the radial depth of the arcuate or circumferential position channels 27 are preferably equal to the radial depth of the travel channel 26. There are preferably as many position channels 27 as there are desired stirrup positions for the saddle 10. Four arcuate position channels 27 are disclosed in the drawings at equally spaced longitudinal intervals. However, more or less than four position channels 27 may be utilized at any desired intervals.

Intercepting each of the position channels 27 and extending rearwardly therefrom in longitudinal alignment along the bottom of the support rod 16 are a plurality of locking channels 28. Each locking channel 28 is preferably of the same radial depth as the position channels 27 and the travel channel 26. Moreover, each locking channel 28 terminates in a rear end wall 29, and is preferably provided with a circular or spherical recess 30 slightly deeper than the locking channel 28. Accordingly, each locking channel 28 has a length less than the longitudinal spacing between each pair of adjacent position channels 27.

Figure 6:
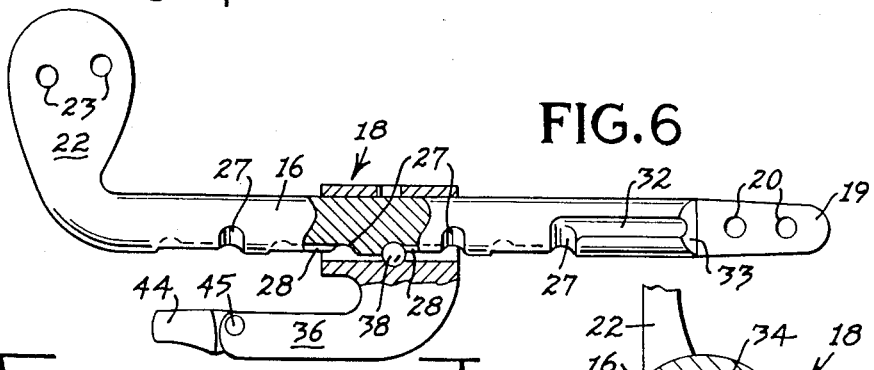
FIG. 6 is a right, or inside, elevational view of the device disclosed in FIG. 2, with portions shown in section.
Figure 5:
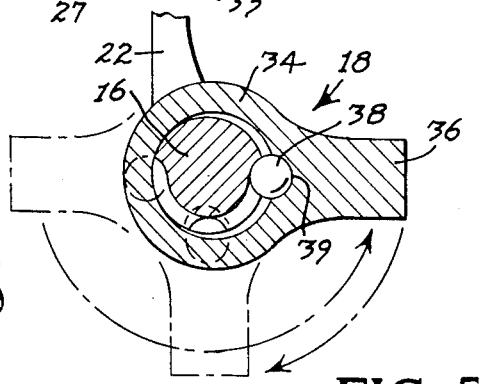
FIG. 5 is an enlarged fragmentary section taken along the line 5—5 of FIG. 4.
Figure 7:
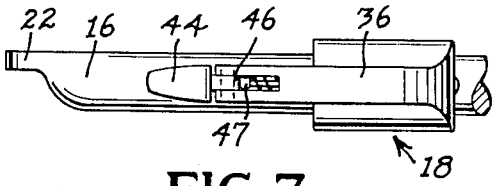
FIG. 7 is a fragmentary bottom plan view taken along the line 7—7 of FIG. 6.

The cylindrical support bar 16 may be provided with an entry channel 32 extending longitudinally in the surface of the support bar 16 along the inside of the support bar 16 and on the opposite side of the support bar from the travel channel 26. This entry channel 32 extends and interconnects with the front position channel 27 and opens through the front end portion 33 of the support bar 16, as best disclosed in FIG. 6. The purpose of the entry channel 32 is to permit assembly and disassembly of the hanger bar member 18 with the support bar 16.

The hanger bar member 18 is preferably an integral piece including an elongated sleeve member 34 having an internal cylindrical bore 35. Integrally connected with the sleeve member 34 and projecting laterally and rearwardly is a hanger bar 36. A small detent, such as the ball or ball detent 38 is seated within a cooperating recess 39 within the bore 35 of the sleeve member 34. The ball detent 38 is of a size or diameter which will permit it to move, slide or roll longitudinally of the travel channel 26, along the position channels 27 and along the locking channels 28. Moreover, the ball detent 38 is adapted to be received in the recess 30 at the end of each of the locking channels 28. The diameter of the sleeve member bore 39 is large enough to permit free movement of the sleeve member 34 axially and circumferentially of the support bar 16, but small enough to confine the ball detent 38 to one of the channels 26, 27, 28, or 32.

The upper portion of the stirrup strap 14 forms a loop 42 which is adapted to be received over the open rear end of, and upon, the hanger bar 36. (FIG. 1)

If desired, a cam-operated keeper detent 44, well-known in the art, may be pivotally connected by the pivot pin 45 to the rear end of the hanger bar 36, in order to normally hold the loop 42 upon the hanger bar 36. However, if a rider should fall from the saddle 10, with his foot caught in the stirrup suspended by the stirrup strap 14, the force of the upper loop 42 of the stirrup 14 against the keeper 44 will force the cam 46 of the keeper 44 against the spring-biased plate 47, causing the strap loop 42 to pivot the keeper 44 to a colinear position with the hanger bar 36, so that the stirrup strap 14 will be released from the hanger bar 36.

In the operation of the support device 15, the hanger bar member 18 is assembled upon the support bar 16 by introducing the sleeve member 34 coaxially over the front end portion 19. By aligning the ball detent 38 with the entry channel 32, the ball detent 38 rides along the entry channel 32 until it encounters the first or front arcuate position channel 27. The ball 38 is then guided along the front position channel 27 until the ball enters the travel channel 26. The sleeve member 34 is then moved longitudinally rearwardly along the support bar 16 until the ball detent 38 registers with corresponding desired arcuate position channel 27. The hanger bar member 18 is then rotated about the support bar 16 until the ball detent 38 registers with the locking channel 28 which intercepts the position channel 27 in which the ball detent 38 is riding. The sleeve member 34 is then moved rearwardly causing the ball detent 38 to ride rearwardly in its corresponding locking channel 28 until the ball detent 38 seats in its locking recess 30 and/or engages the rear end wall 29, to limit the rearward movement of the detent 38 within the locking channel 28.

After the hanger bar member 18 is assembled upon the support bar 16, and either before or after the hanger bar member 18 is adjustably positioned upon the support bar 16, the support bar 16 is fixed to the saddle 10 or saddle tree, not shown, by connecting the fasteners 24 through the corresponding fastener holes 20 and 23 to the saddle 10 or saddle tree. In this mounted position, the support bar 16 extends substantially horizontal and longitudinally along one side of the saddle. In FIG. 1, the stirrup support device 15 is shown mounted upon the left side of the saddle 10. A corresponding stirrup support device, which is a mirror image of the left stirrup support device 15, is secured to the corresponding right side of the saddle 10, in the same manner as the stirrup support device 15.

After the hanger bar member 18 is longitudinally adjusted to its desired position, the stirrup strap 14 is secured by its upper loop 42 over the rear end of the hanger bar 36 until the stirrup 14 is fully supported by the hanger bar 36. If desired, the keeper 44 may be pivoted from its horizontal position disclosed in FIGS.

Figure 2:
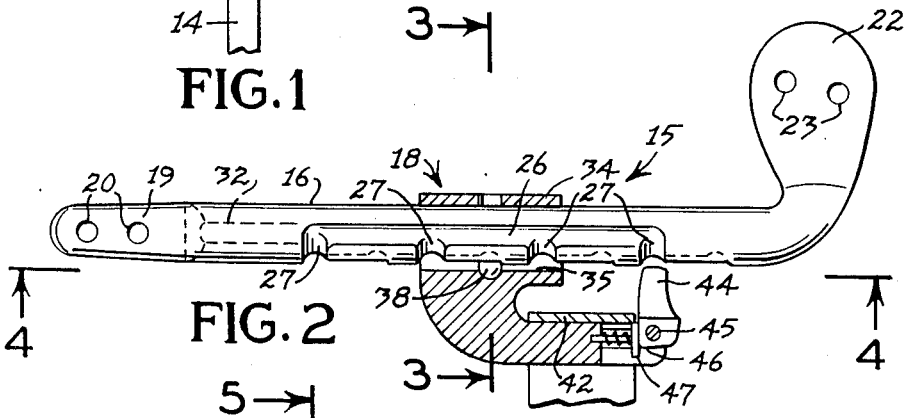
FIG. 2 is an enlarged left, or outside, elevation of the support device of FIG. 1, removed from the saddle, and with the hanger bar member shown in section.
Figure 3:
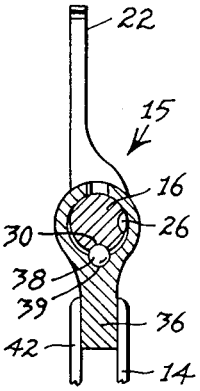
FIG. 3 is a fragmentary section taken along the line 3—3 of FIG. 2.
Figure 4:
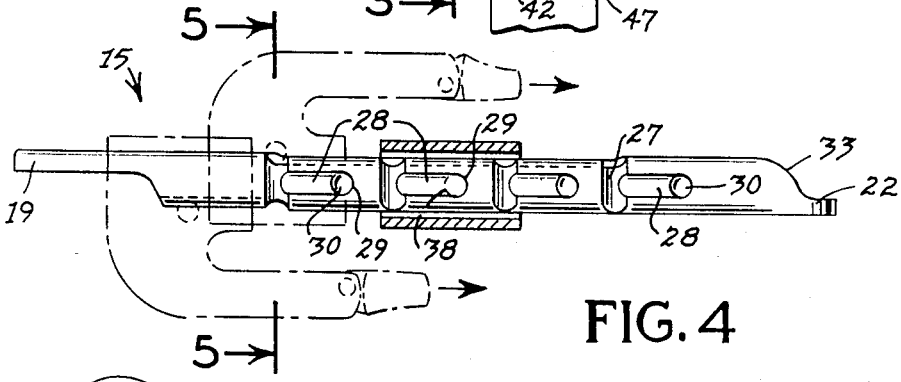
FIG. 4 is a bottom sectional view taken along the line 4—4 of FIG. 2, with the hanger bar member shown in various operative positions in phantom.

6 and 7 to its upright position disclosed in FIG. 2, in order to assist in holding the stirrup strap loop 42 upon the hanger bar 36.

While the rider is mounted in the saddle 10 with his feet in the stirrups, the hanger bar member 18 will be retained in its locked position against counter-rotation about the cylindrical support bar 16, because the ball detent 38 is secured within, not only the locking channel 28, but also in the ball recess 30.

Should the rider have an accident and fall from the saddle 10 with his foot still in one of the stirrups, the force of the stirrup strap 14 against the keeper 44 will force the keeper down to its horizontal or colinear position with the hanger bar 36 permitting the stirrup strap 14 to slip rearwardly off of the stirrup bar 36 so that the rider will not be dragged along with the saddle 10 secured to the horse.

If the rider, mounted upon the saddle 10, desires to change the longitudinal position of the stirrup and stirrup strap 14, he may release his left foot from the stirrup or merely release the pressure of his left foot upon the stirrup, raise the side flap 12 and move the hanger bar member 18 axially forward until the ball detent 38 occupies the corresponding arcuate position slot 27. The hanger bar 36 is then raised outward and upward until the ball detent registers with the travel channel 26, in which attitude, the sleeve member 34 is moved either forward or rearward until the ball detent registers with the desired arcuate position slot 27. The hanger bar 36 is then lowered until the ball detent 38 registers with its corresponding locking channel 28 and the sleeve member 34 is moved rearwardly until the ball detent 38 occupies its locking recess 30. The side flap 12 is then lowered and the left foot restored to the stirrup, and riding resumed.

It will therefore be seen that a stirrup support device 15 has been designed which will not only permit ready release of the stirrup strap 14 from the hanger bar 36 in the event of an accident, and will also permit rapid adjustment of the hanger bar member 18 to various longitudinal positions along the stirrup bar 16 for the comfort of the rider, but will also lock the hanger bar member 18 in its adjusted position, without the danger of the hanger bar member 18 becoming inadvertently disengaged and shifted from its desired locking position, without a positive effort by the operator or rider with the intention of changing such position.

What is claimed is:

1. A support device for adjustably attaching a stirrup strap to one side of a riding saddle, comprising:

(a) an elongated support bar having front and rear portions, a longitudinal front-to-rear axis, and a generally cylindrical coaxial surface, (b) means securing said front and rear end portions to one side of a saddle, (c) an elongated travel channel formed longitudinally in said surface of said support bar parallel to said longitudinal axis, (d) a plurality of longitudinally spaced position channels formed circumferentially in said cylindrical surface and intersecting said travel channel, (e) an elongated locking channel formed longitudinally in said surface, spaced circumferentially from said travel channel, and intersecting and projecting rearward from a corresponding position channel, (f) a hanger bar member comprising an elongated sleeve member and a hanger bar secured to and projecting longitudinally rearward from said sleeve member for receiving the upper end of a stirrup strap, (g) said sleeve member having a substantially cylindrical bore receiving said support bar and adapted to be moved axially and circumferentially of said support bar, (h) a detent projecting radially inward from said bore and adapted to freely move along and within any of said channels in registry with said detent, whereby said sleeve member may be axially moved along said support bar when said detent registers with said travel channel, and rotated to any position corresponding to one of said position channels in registry with said detent, and locked against rotary movement relative to said support bar when said detent is received in said corresponding locking channel, and (i) limit means limiting the rearward movement of said detent in said locking channel.

2. The invention according to claim 1 in which said limit means comprises a closed rear end in each of said locking channels.

3. The invention according to claim 2 in which the length of each of said locking channels is less than the longitudinal spacing between said position channels.

4. The invention according to claim 1 in which said limit means comprises a recess at the rear end of each of said locking channels being radially deeper in said support bar than said corresponding locking channel for receiving said detent in a locking position.

5. The invention according to claim 4 in which said detent is a ball detent and said recess has a corresponding spherical shape for receiving said ball detent.

6. The invention according to claim 1 in which said locking channels are colinear and parallel to said travel channel and the longitudinal axis of said support bar.

7. The invention according to claim 1 in which said travel channel, said position channels, and said locking channels have substantially uniform radial depths in said support bar.

* * * * *